US006334933B1

(12) United States Patent
Koski

(10) Patent No.: US 6,334,933 B1
(45) Date of Patent: Jan. 1, 2002

(54) PRESS

(75) Inventor: Ilpo Koski, Pori (FI)

(73) Assignee: Metso Chemical Pulping Oy, Pori (FI)

( * ) Notice: Subject to any disclaimer, the term of this patent is extended or adjusted under 35 U.S.C. 154(b) by 0 days.

(21) Appl. No.: 09/700,339

(22) PCT Filed: Apr. 12, 2000

(86) PCT No.: PCT/FI00/00304

§ 371 Date: Dec. 14, 2000

§ 102(e) Date: Dec. 14, 2000

(87) PCT Pub. No.: WO00/65152

PCT Pub. Date: Nov. 2, 2000

(30) Foreign Application Priority Data

Apr. 14, 1999 (FI) ..... 990823
May 5, 1999 (FI) ..... 991029

(51) Int. Cl.[7] ..... D21F 3/02; D21H 11/00
(52) U.S. Cl. ..... 162/358.3; 162/361; 100/153
(58) Field of Search ..... 162/109, 111, 162/117, 204, 205, 206, 274, 358.1, 358.2, 358.3, 358.4, 358.5, 359.1, 360.2, 360.3, 361; 100/153

(56) References Cited

U.S. PATENT DOCUMENTS 4,568,423 A 2/1986 Laapotti ..... 162/358
4,576,682 A * 3/1986 Laapotti ..... 162/358.3
4,586,983 A * 5/1986 Laapotti ..... 162/205
5,071,513 A 12/1991 Bluhm et al. ..... 162/206
5,980,693 A * 11/1999 Liang et al. ..... 162/358.3

FOREIGN PATENT DOCUMENTS

| | | | |
|---|---|---|---|
| CH | 152/86 | 1/1988 | D21F/3/02 |
| DE | 3030233 | 2/1982 | D21F/3/02 |
| FI | 896163 | 2/1998 | D21F/3/02 |
| SE | 8401588-2 | 9/1984 | D21F/3/02 |
| SE | 8801933-6 | 1/1990 | D21F/3/02 |
| SE | 9201269-9 | 10/1992 | D21F/3/02 |
| SE | 9103823-2 | 8/1993 | D21F/3/02 |
| SE | 9201497-6 | 12/1993 | D21F/3/02 |

* cited by examiner

*Primary Examiner*—Peter Chin
*Assistant Examiner*—Eric Hug
(74) *Attorney, Agent, or Firm*—Burns, Doane, Swecker & Mathis, L.L.P.

(57) ABSTRACT

A press for the dewatering of a fiber web, comprising a roll, a counterpart and and an endless press belt adapted to glide around the counterpart. Into the concave press zone region of the counterpart, a flexible press plate is adapted, anchored to the counterpart at the leading edge of the counterpart, relative to web motion. Beneath the press plate, hydrostatic pressure chambers are provided, separated from each other by means of flexible pressure lines. By individually controlling the pressures of the chambers, the leads and optionally the press plate edges, a desired pressure profile is obtained across the extended pressure zone.

12 Claims, 10 Drawing Sheets

PRESS

The invention relates to the field of fibre web dewatering. In particular, the invention relates to a long pressing zone press for the treatment of a fibre web.

The dewatering of a fibre web is usually performed by means of roller presses by leading the web via a press zone formed by two rolls, i.e. through a press nip. The web runs through the nip between press felts, and the felts carry away the water squeezed out of the web.

In a nip formed by two rolls, the greatest press force is reached as a narrow peak in the middle of the nip. This is disadvantageous both to the dewatering process and to the service life of the felts because the pressing is of very short duration at high speeds and great stress is put on the felts. Therefore, different kinds of so-called long nip presses have been constructed wherein one roll can be substituted by a concave counterpart, a press shoe. On the shoe side, to the rotary motion of the roll is usually matched by a watertight, endless loop of fabric, a press belt, that follows and glides on the surface of the lubricated counterpart. The press belt is supported by separate rolls, or alternatively the counterpart or the support of the shoe are made in such a form that a short belt can glide around it, the lubrication being arranged on the inside of the endless loop formed by the belt. By the use of shoe presses, nips are achieved whose effective length can be approximately 250–310 mm, depending on the size of the roll. In addition to roll/shoe combinations, patent documents mentioned below disclose presses composed of two opposite shoes.

In order to obtain an optimal dewatering effect, it is desirable that the press force can be adjusted within the nip zone. The incoming web, having a low dry solids content, cannot initially take a high pressure without breaking, and a compression force profile of the wrong shape can cause quality problems in the web if, for example, the water cannot be properly absorbed by the felt, but channels in the web. In order to achieve the final desired degree of dryness, the pressure peak has to be provided at the end of the pressing stage.

Many different approaches have been taken to obtain this result. Patent application CH5152/86 discloses a press shoe. On its surface, under the press belt, are provided cavities that serve as hydrostatic pressure chambers when hydraulic fluid is led into them through channels formed in the shoe. In addition to pressure, a stepwise heat treatment is achieved for the web by individually regulating the temperature of the hydraulic fluid in the separate chambers. Patent application FI 896163 also discloses a press shoe having a plurality of pockets on its sliding surface for feeding an individually pressurised lubricant, the pressure profile being adjustable in the nip zone for desired pressing and web speed conditions. Swedish patent application SE 9103823-2 discloses a press shoe provided with a pressure pocket, wherein the depth profile of the pressure pocket results in a combination of hydrostatic and hydrodynamic effect for obtaining a desired compression pressure profile. Swedish patent application SE 9201497-6, in addition to a profiled pressure pocket, comprises a heat control system for the front edge and for the back edge to prevent torsional forces from being generated as a result of temperature differences due to friction.

Further attempts have been made to affect the compression pressure profile by adjusting the tilt angles of the shoe. In the last-mentioned Swedish patent application 9201497-6, for example, is described how the front and the back edges of the shoe are supported by individually regulated hydraulic cylinders. German patent application DE 4113623 discloses a press shoe attached to a shoe base that together with its supporting framework forms a hydraulic piston/cylinder construction that is not only radially movable but also tiltable. Swedish patent application SE 8801933-6 also discloses a press shoe construction comprising in addition to a hydrostatic pressure pocket, lines of jacks under the front and back edges of the shoe, enabling tilting.

According to Finnish patent FI 70952, the compression pressure profile is adjusted in the different zones of the shoe surface by mounting separately controlled pressing elements in the surface of the press shoe. In addition, hydrostatic pressure chambers that have a direct influence on the press belt are arranged between the pressing elements, on the surface of the press shoe. Thus, the pressing elements serve as edge seals for the pressure chambers. In an embodiment according to Finnish patent FI 71369, the surface of the shoe is constituted by a sliding plate, one or more pressure hoses being arranged under the plate and mounted in the shoe.

The objective is to reach a maximum compression force of about 8 MPa. This requires great rigidity of the roll of a long nip press. In connection with shoe presses, the roll is prevented from bending by employing compensating constructions, a line of hydraulic regulating cylinders and sliding bearings, inside the roll. Such a design is, however, quite expensive and mechanically complicated.

The object of the present invention is to provide a simple long nip press construction that is suitable for the dewatering of pulp and paper webs and that comprises a press zone provided with a number of adjustment possibilities. The solution is obtained through the construction according to claim 1, comprising a roll and a concave counterpart whose sliding face is constituted by a press plate that, on the side of the incoming web, is anchored in the counterpart at one edge, the other edge of the plate being movably mounted in the counterpart. Under the press plate, in the surface of the counterpart, are provided hydraulic pressure chambers. The seals between these are constituted by flexible pressure pipes arranged perpendicularly to the web direction. Thus, the press plate forms a long nip by partly wrapping the web round the backing roll. No actual press shoe is used, as a result of which no hydraulic cylinder control systems, typical of shoe presses for controlling the position and the radial location of a shoe, are required. Accordingly, the structure of the press is considerably straightforward but provides sufficient possibilities to control and to differentiate the pressing force across the whole nip zone, and consequently, to influence the properties of the pulp web leaving the press.

Figure 1:
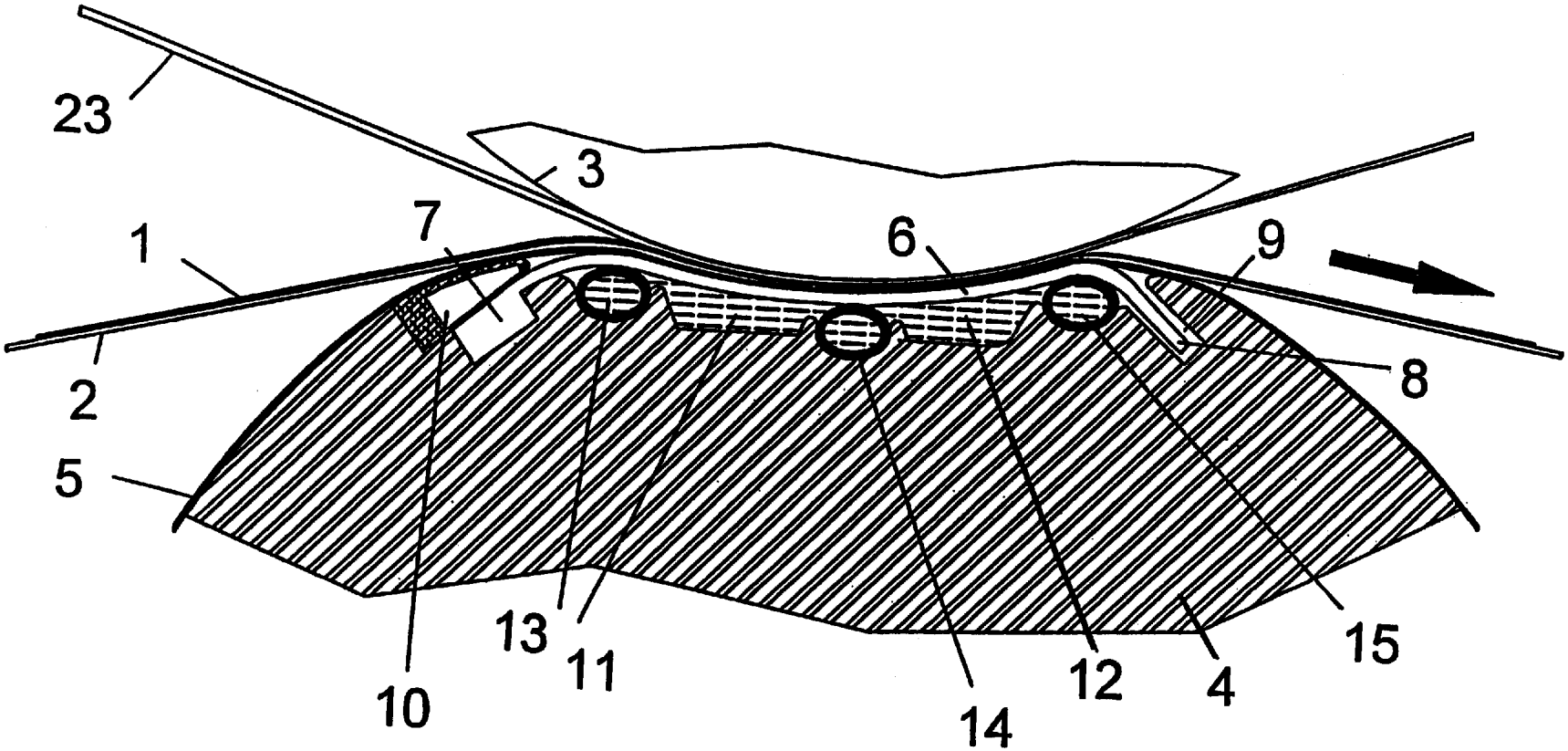
FIG. 1 is a sectional view of the structure of a press nip according to the invention, taken in the direction of web motion.

The invention will be described in more detail in the following, with reference to the accompanying drawings. FIG. 1 is a sectional view of the nip of the press according to the invention, taken in the direction of motion of the web. A fibre web 1 enters the press from the left, supported by a lower felt 2. The press zone is constituted by the nip between a roll 3 and a counterpart 4 where the web is pressed between the lower felt 2 and an upper felt 23. An endless press belt 5 impervious to liquid glides on the counterpart 4. The material thereof can be polyurethane fabric or rubber, for example. The surface of the press belt can be smooth, or grooved in order to make the dewatering more effective. Preferably, the counterpart is designed to enable the press belt to glide thereon without external auxiliary rolls, with the result that the counterpart and the belt form a closed unit. Thus, the system providing the lubrication between the press belt and the counterpart functions in a known manner by circulating oil within said unit.

In the press zone, the surface of the counterpart is constituted by a flexible press plate 6 that follows the curvature of the roll. The plate is anchored, on the side of the feeding direction of the web, in the counterpart by a shaped edge 7. The other end 8 of the plate 6 is movably mounted in a groove 9 formed in the counterpart. The plate is hence radially movable to a limited extent in relation to the counterpart.

Preferably, the press plate 6 is made from steel, and its surface is polished or treated in other ways so as to reduce friction between the plate and the press belt. Other materials, such as bronze, or chromium-teflon plated materials, may be used as appropriate. The thickness of the steel plate is preferably about 8 mm. In order to achieve a suitable amount of flexibility, the press plate can comprise zones of different thickness.

Lubricant is fed between the press belt 5 and the plate 6 from a nozzle lubricator 10.

Figure 2:
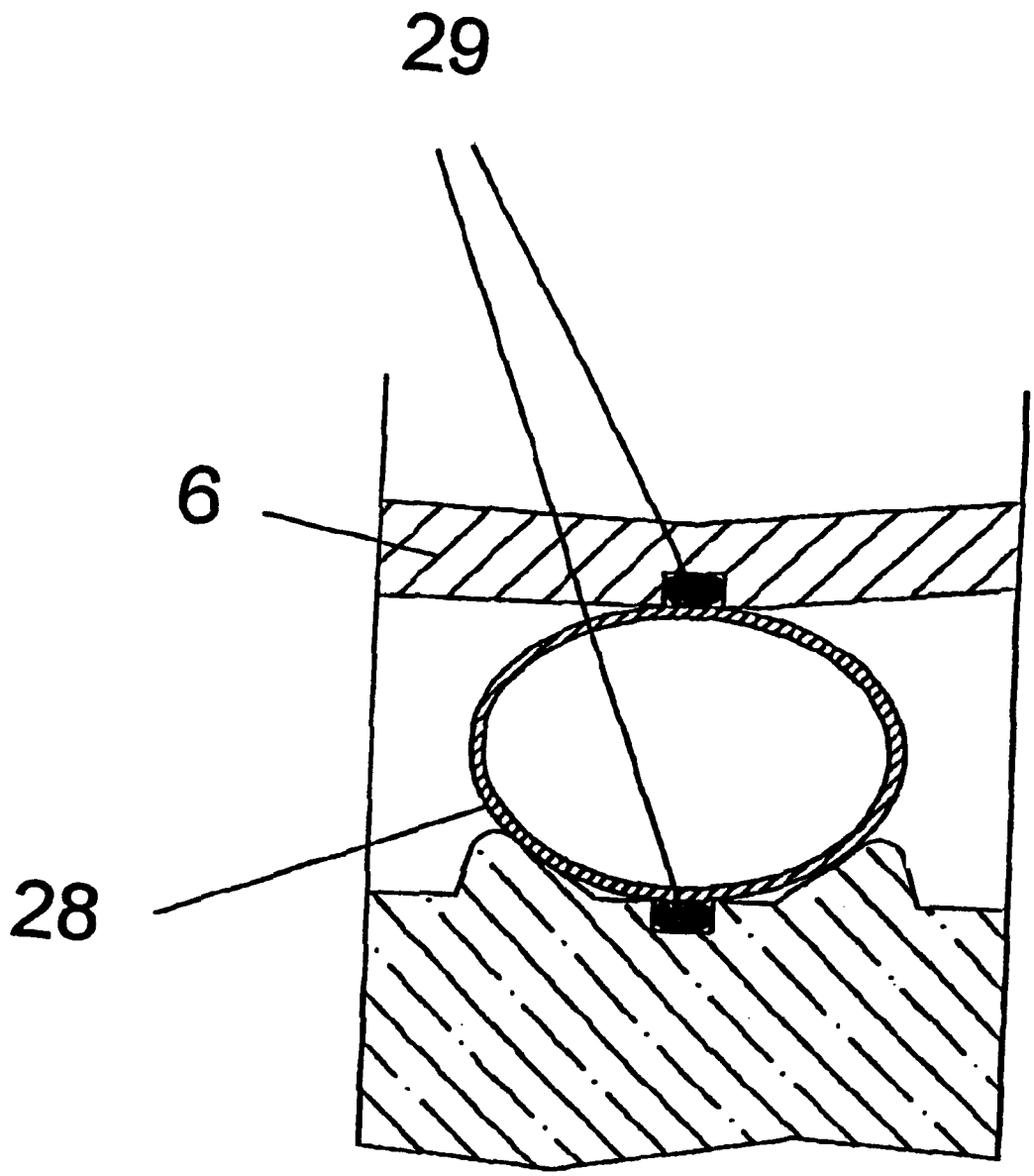
FIG. 2 shows an alternative embodiment of the press shown in FIG. 1 as far as the pressure lines and the sealing of them are concerned.

Under the plate, on the surface of the counterpart, are provided hydrostatic pressure pockets; the embodiment shown in FIG. 1 comprises two of these, 11, 12. The sealing of the pressure pockets and the sealing of the outermost pocket at the trailing edge of the web are provided by flexible pressure hoses 13, 14, 15 arranged in the longitudinal direction of the counterpart. FIG. 2 shows a detail of the embodiment, wherein thin steel pipe 28 is used instead of pressure hoses, and wherein the sealing is provided by rubber seals 29, having a round profile and being mounted on opposite surfaces, one on each of the steel pipe. As shown in the figure, the steel pipe 28, when it is not in a pressurised state, can have an oval cross-section to provide enough play for press plate 6.

A hydraulic fluid at a set pressure is circulated in pressure pockets 11, 12, whereby the fluid thus also provides cooling. In order to equalise the temperature, the flow of the hydraulic fluid can be so arranged, for example, that the fluid enters the pressure chambers from opposite ends. The inlet can be situated in the middle and the outlet at the ends in one pocket, the arrangement in the adjacent pocket being the reverse. Furthermore, the pressure pocket can comprise baffle plates parallel to the direction of web motion, to ensure that the hydraulic fluid follows the desired path.

The arrangement according to the invention results in good adjustability of compression force across the whole press zone. In the embodiment shown in FIG. 1, the pressures in the pressure lines 13, 14, 15 (or 28) are kept sufficiently high in comparison with the pressures in the adjacent pressure pockets to prevent any fluid flow from one pocket into another. The pressure level maintained in the pressure lines is determined by the diameters and by the rigidity of the walls. A desired pressure profile is achieved in the press zone by adjusting the pressure of the pressure pockets. The outermost pressure line in the direction of web motion, i.e. pressure line 15 at the trailing edge, can also participate in the creation of the pressure profile. Lubrication is provided by means of a lubricant feed pipe 10 embedded in the counterpart, from which pipe lubricant is delivered between the press belt 5 and the press plate 6. The lubricant circulates, carried by the press belt, into recovery channel systems provided in counterpart 4, from which it is circulated, via a cooling system, back into the lubrication pipe 10.

Figure 3:
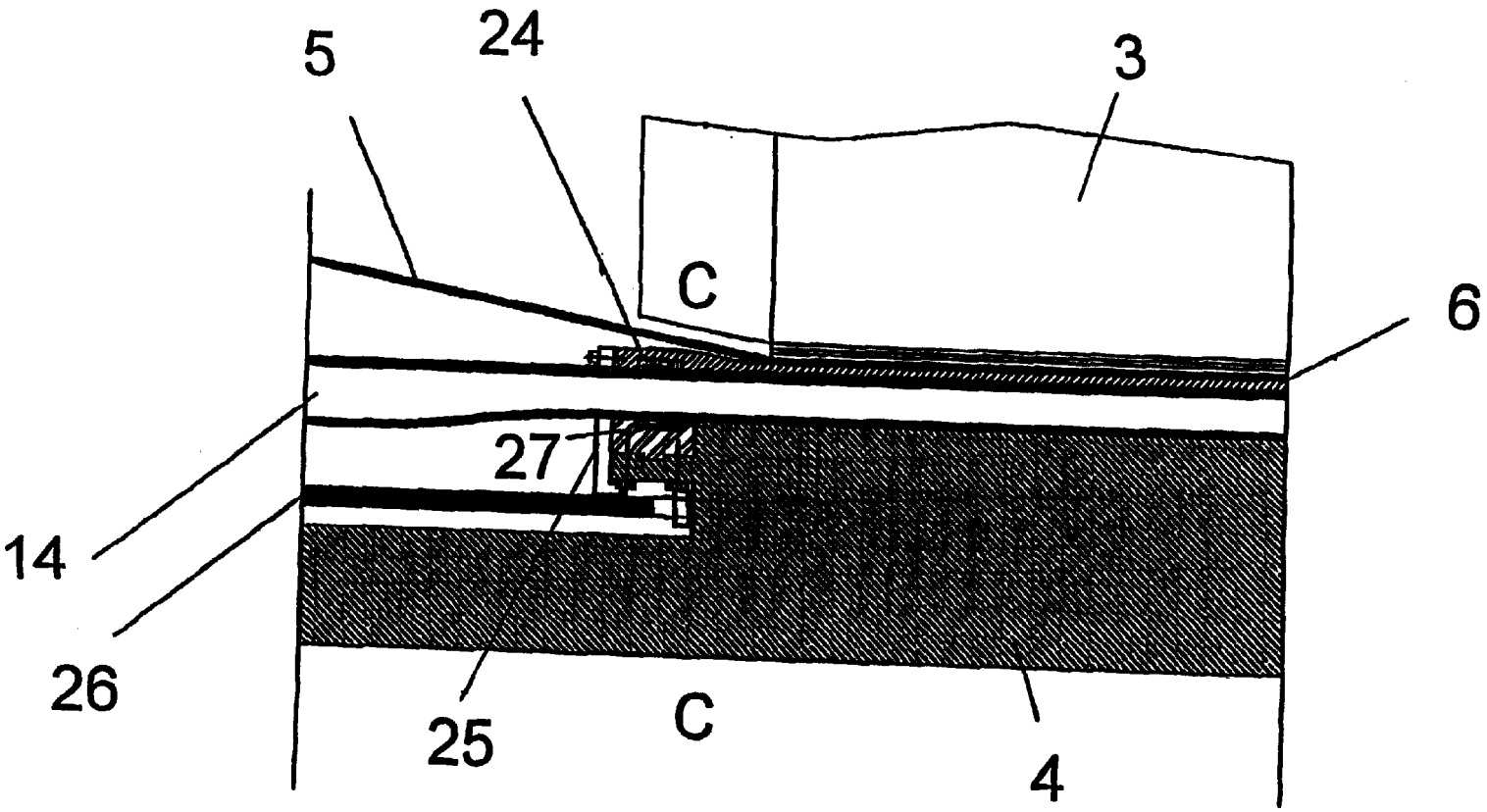
FIG. 3 is a sectional view of a part of the press shown in FIG. 1, taken in the longitudinal direction of the roll and at the end of the roll.

FIG. 3 shows how the ends of the pressure pockets, in the embodiment shown in FIG. 1, can be sealed by means of rubber gaskets 24 that are vulcanised or glued onto pressure hoses 14, and onto the press plate 6 and onto a piece 27 fixed by bolts to the body of the counterpart 4. In the spaces between the pressure hoses 14 (or the pipes 28, FIG. 2), plates 25 can be provided, which are fixed to the press plate 6 at their upper edge and movable with it, so as to support the gasket and to limit its vertical movement. Hoses 26 can be used to supply oil to pressure pockets 11, 12.

Figure 4:
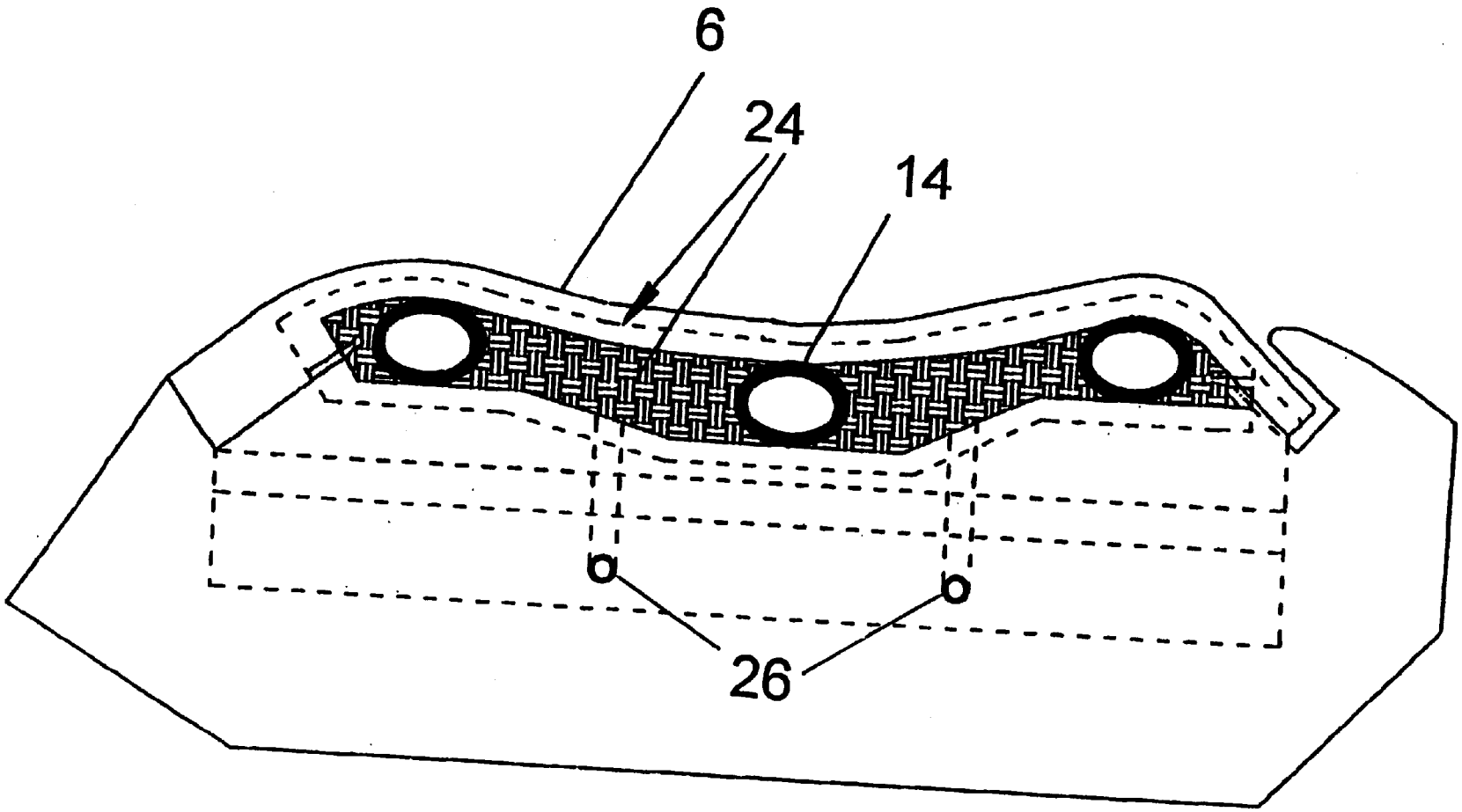
FIG. 4 is a sectional view of the structure of the end of the press shown in FIGS. 1 to 3, taken in the direction of web motion and at location C—C of FIG. 3.

FIG. 4 is a sectional view of the end shown in FIG. 3, in the direction of web motion at location C—C.

Figure 5:
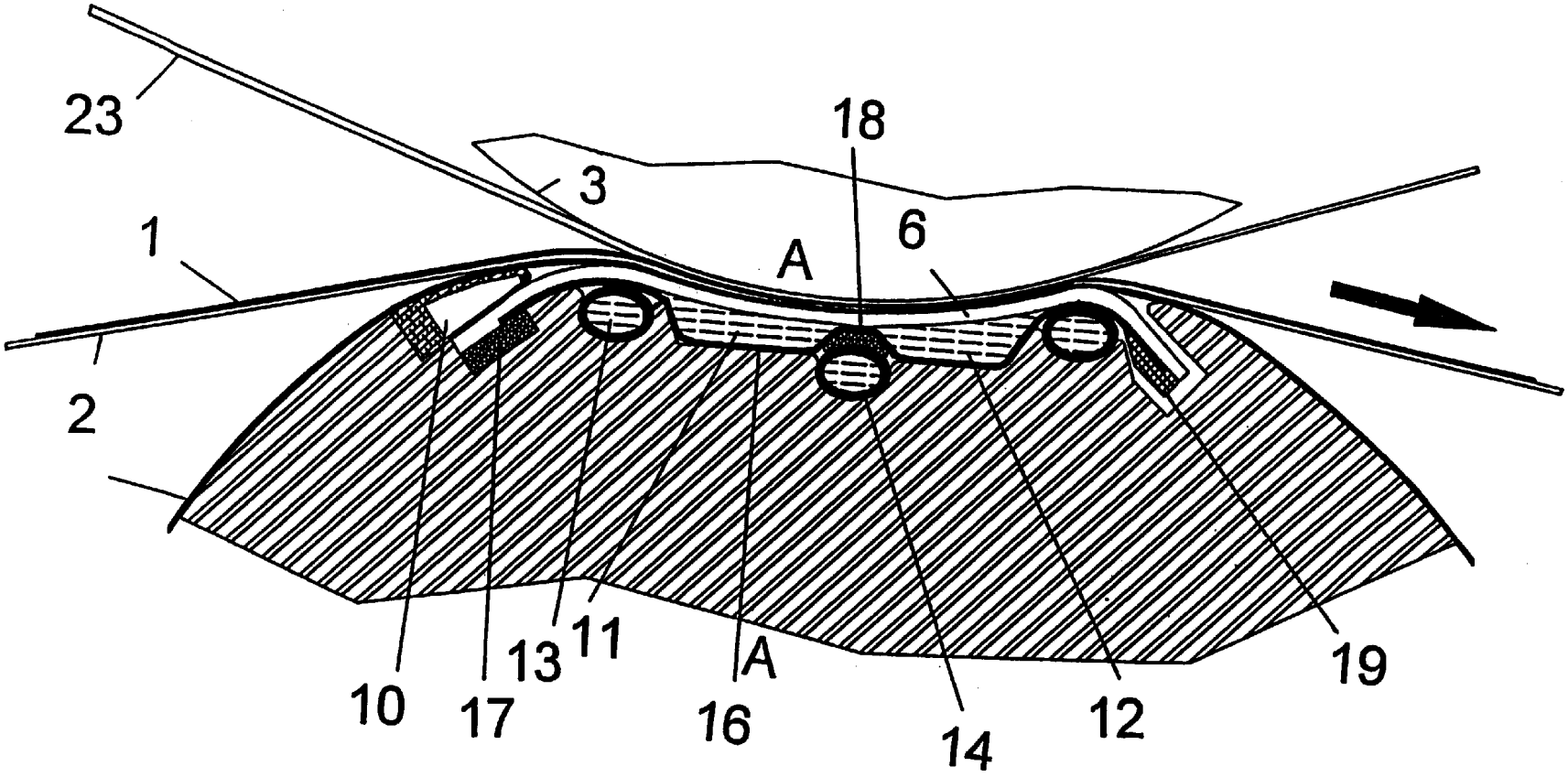
FIG. 5 shows another embodiment of a press according to the invention, in the same way as FIG. 1.

According to another embodiment of the invention, shown in FIG. 5, the sealing of the pressure pockets is secured by means of an elastic film 16 following the bottoms of the pressure pockets. The film is attached to the press plate by fasteners 17, 18, 19. These can be, for example, steel fittings having a suitable profile and extending over the whole width of the press plate, and being fixed to the press plate by bolts so that the elastic film is pressed between the fasteners and the press plate. As the elastic film follows the bottom of the pressure pockets and the surfaces of the pressure hoses abutting the press plate, any flow of hydraulic fluid from one pressure pocket to another and from the pressure pockets into the surroundings is completely prevented.

Figure 6:
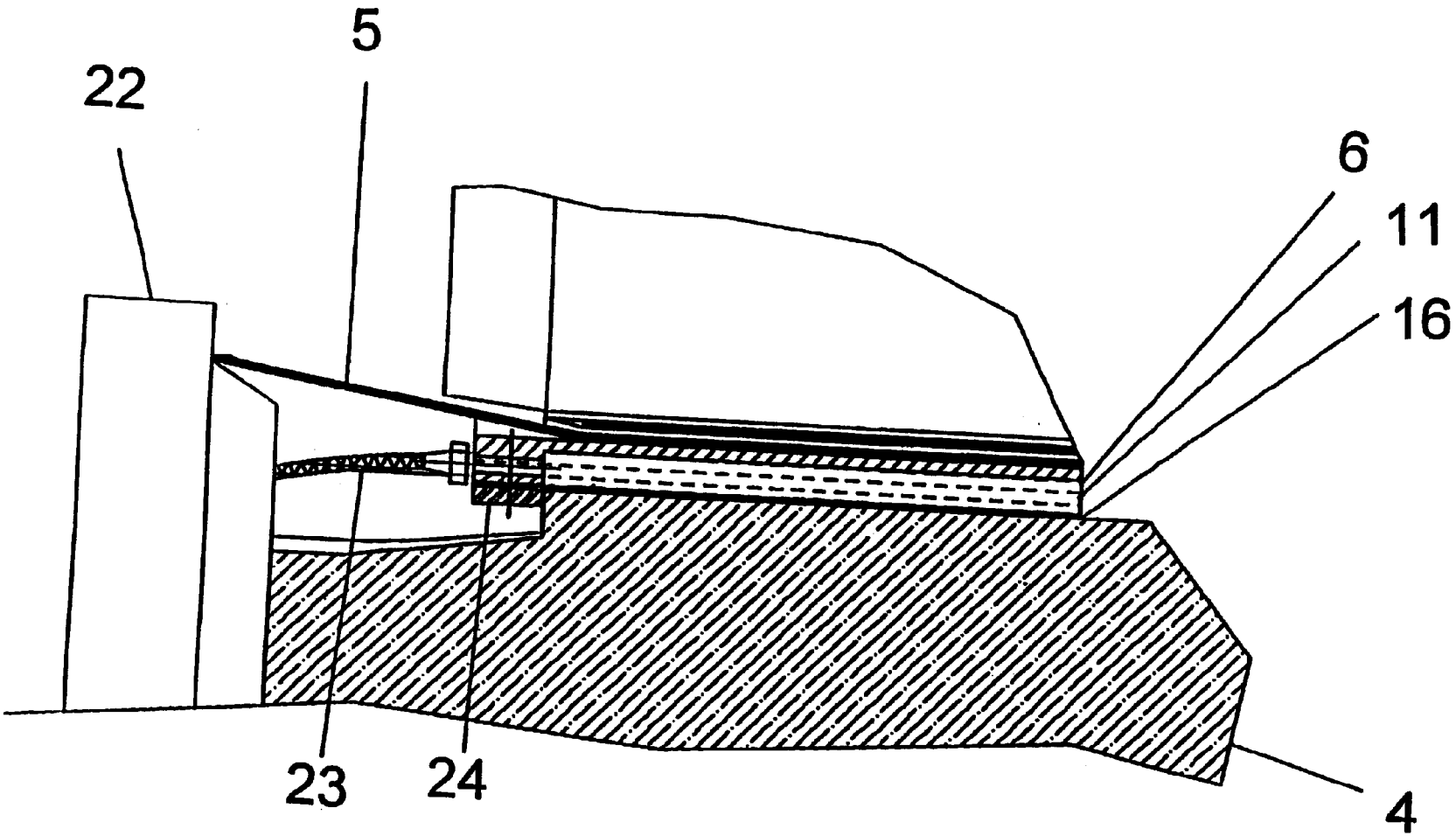
FIG. 6 is a sectional view of the end of the press shown in FIG. 5, taken across the direction of motion and at location A—A.

In this embodiment, the pressure pockets can be sealed at the ends of the press without glueing, because the elastic film 16 and the press plate 6 can be thus pressed together, that the film, the press plate and the end-piece 24 form an enclosed space. FIG. 6 is a sectional view of the end of the press shown in FIG. 5, taken across the direction of motion and at location A—A. The press belt 5 is attached to a rotary end unit 22. The supply of oil to pressure pocket 11 is provided by hose 23. The elastic film 16 and the press plate 6 are fixed to end-piece 24, for example by screws.

Figure 7:
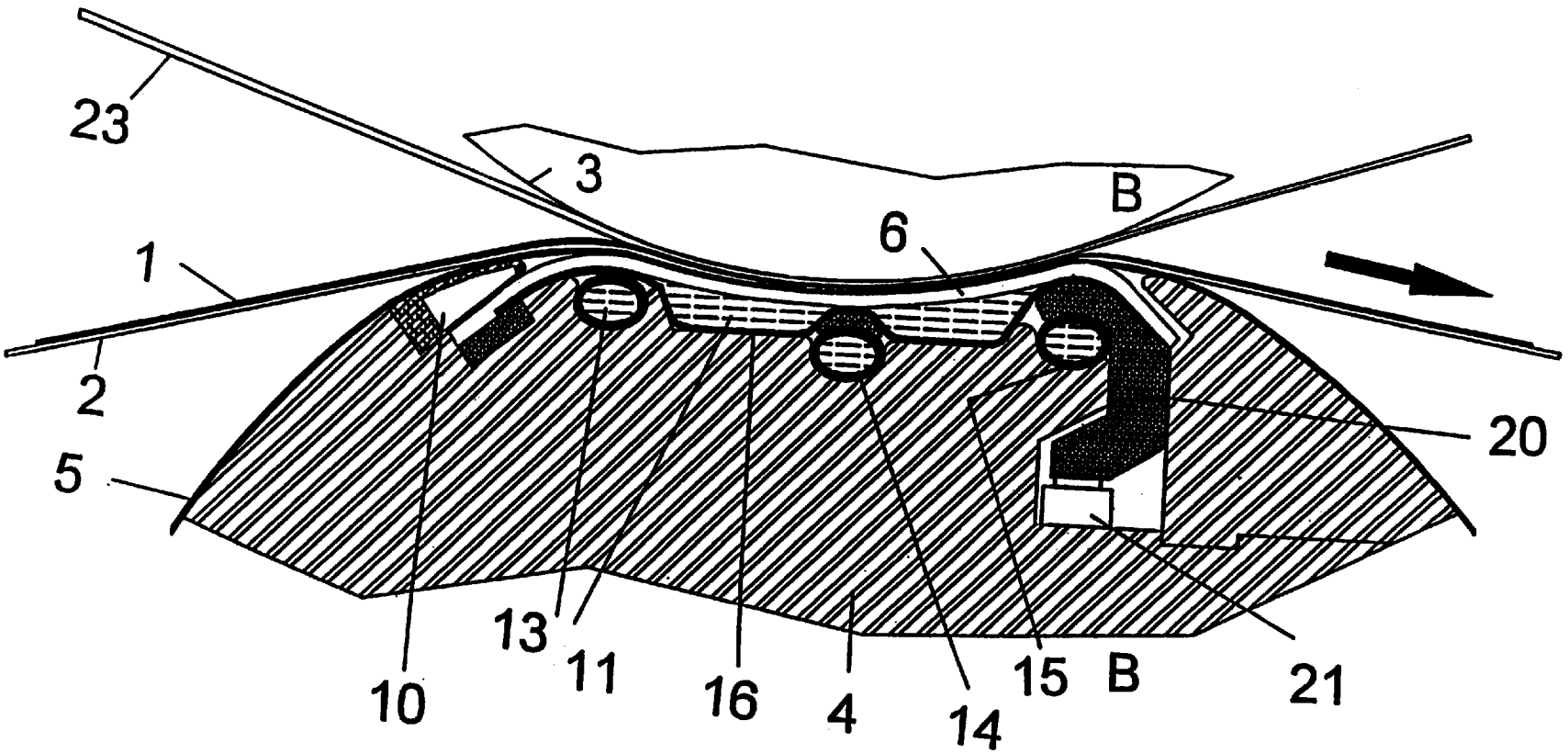
FIG. 7 shows a third embodiment of the press according to the invention.
Figure 8:
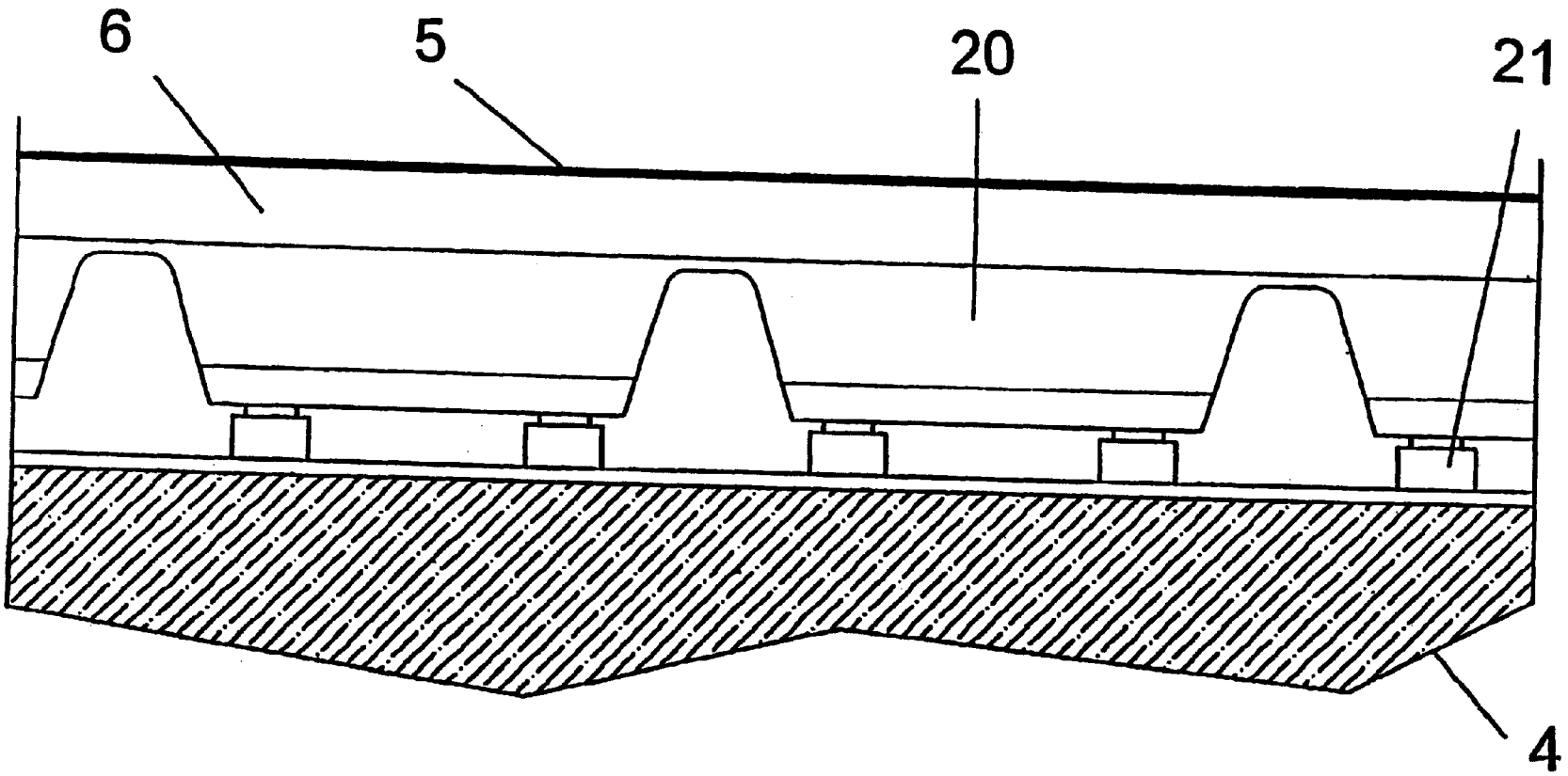
FIG. 8 is a sectional view of the centre of the press, taken across the direction of motion and at location B—B.

According to a third embodiment of the invention, shown in FIG. 7, a beam 20, in addition to the pressure line 15, is arranged in connection with the trailing edge of the press plate. Using the beam, the trailing edge can be pushed toward roll 3 by means of a line of hydraulic cylinders 21 arranged between the beam and the body of counterpart 4. This arrangement makes it possible to individually adjust the compression force in the different lateral zones of the press, as the hydraulic fluid can be fed into the hydraulic cylinders at individually set pressures. FIG. 8 is a sectional view of the centre of the press shown in FIG. 6, taken across the direction of web motion and at location B—B. Preferably, the hydraulic cylinders 21 are divided into groups of two or more cylinders, in which case the zone specific adjustability is provided by forcing beam 20 into corresponding shapes, for example as shown in FIG. 8. It is possible, for example, to keep the pressure at a basic level at the trailing edge of the press plate by means of hose 15, and to adjust the compression force zone by zone, by means of cylinders or cylinder groups, depending on how much pressing the web requires according to real-time water content measurements. Any bending of the roll or any roll asymmetry that may arise can thus be compensated.

Figure 9:
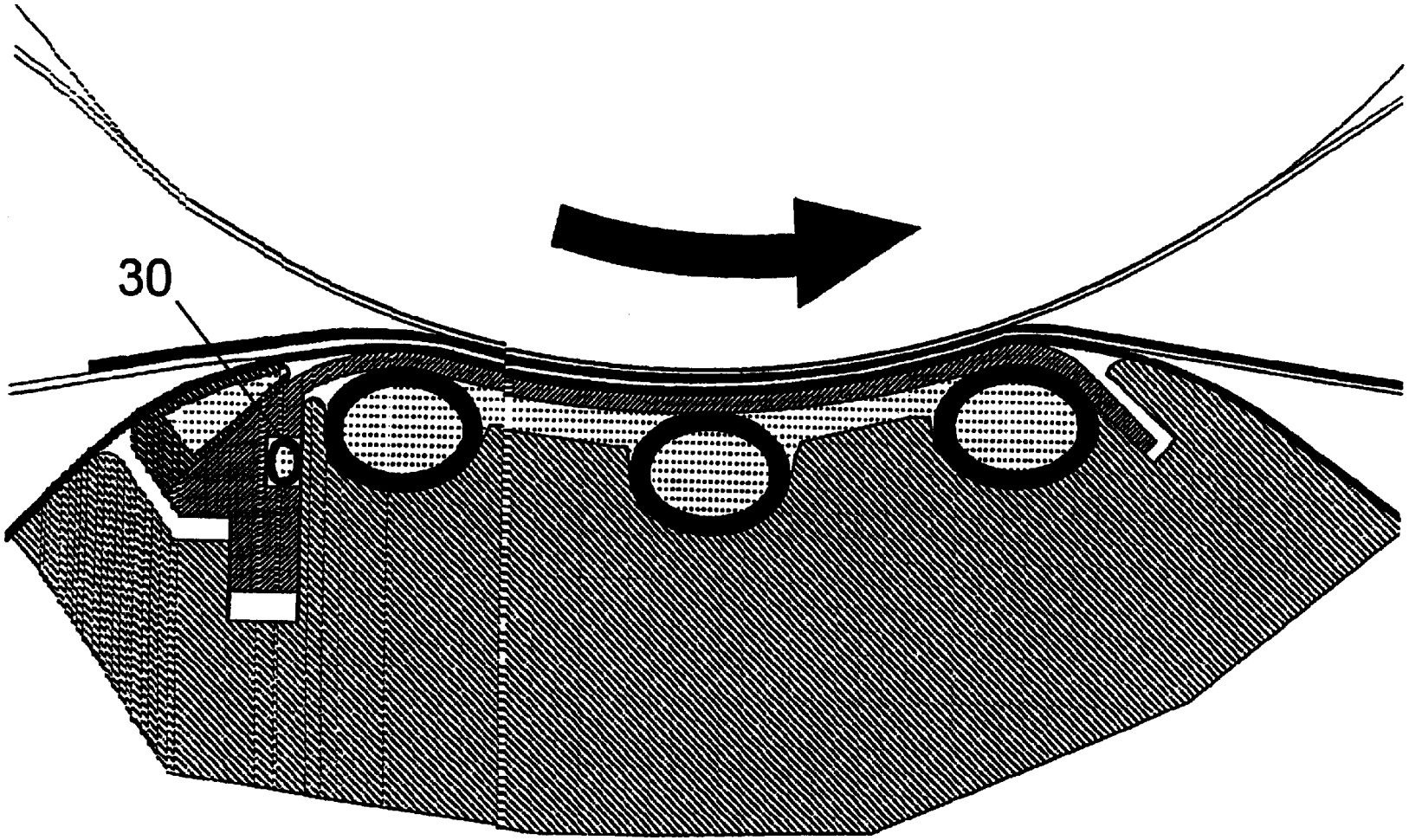
FIG. 9 shows a fourth embodiment of the press according to the invention.

FIG. 9 shows an embodiment, wherein the front edge of the press plate is anchored in the counterpart to allow a greater movement toward the roll than in the embodiments according to FIGS. 1, 5 and 7. In this case, in order to prevent sticking, an device 30 is fitted in the joint between the press plate and the body of the counterpart. The device can be a pressure line to which a pressure high enough to disengage the press plate from the counterpart is led. It can also be a roll, for example, or a corresponding mechanical device.

A beam 20 can be placed in the presses shown in FIGS. 1 and 9 as well, in which case the sealing system shown in FIG. 2 can be arranged between the beam and press plate 6.

In the embodiments shown in FIGS. 1, 5, 7 and 9, there are two pressure chamber sections and three pressure hoses or pipes in the press zone. The invention is not, however, restricted to these numbers. Other combinations can also be employed within the scope of technically meaningful solutions, depending on the desired pressing force profile.

The present invention provides substantial advantages in comparison with the long nip presses according to the prior art. The shape of the nip of a shoe press is tied to the shoe profile. The press felts wear and become flat during use, resulting in that the compressable body formed by the felts, the web and the press belt, may decrease up to 5 mm in thickness during the service life of the felts. The press shoe and the backing roll have substantially constant curvatures. Thus, the effective nip profile of a shoe press changes considerably during the service life of the felts, which also restricts the useful length of the nip. In the press according to the invention, the shape of the nip can be adjusted. The nip has, therefore, substantially the same profile during the whole service life of the felts. At the same time, a considerably longer nip than in a shoe press can be used.

Figure 10:
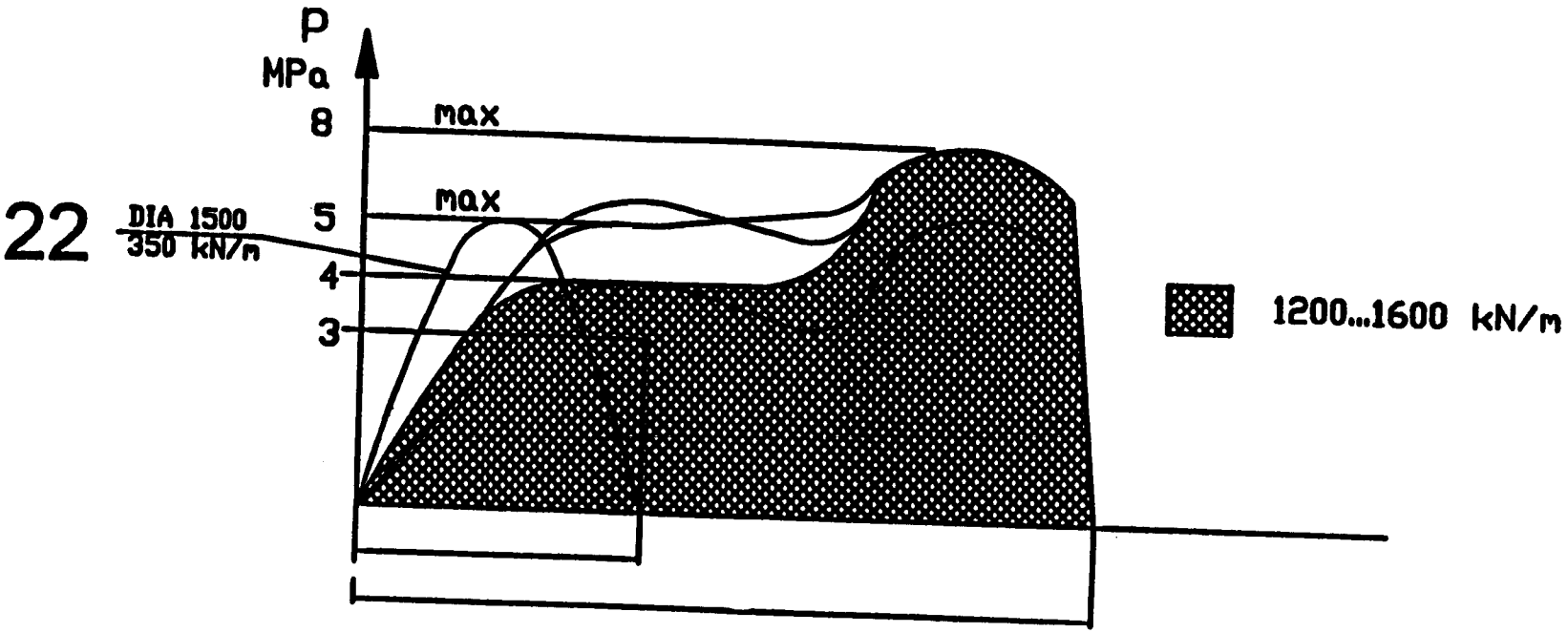
FIG. 10 shows the compression force profile obtained by means of a press according to the invention.

FIG. 10 shows an example of the compression pressure profile a press according to the invention may produce in the direction of web motion. The curve 22 represents a pressure profile produced by a pair of 1500-mm diameter rolls, whereby the effective length of the nip is restricted to about 100 mm. It is clear that the maximum pressure, about 5 MPa, is reached in the middle of the nip, and that the web is subjected to a pressing force of about 350 kN/m. The four other curves in the figure stand for compression pressure profiles that can be produced by means of the press according to the invention, by individually adjusting the pressure of pressure pockets 11, 12 and of pressure lines 13, 14, 15 (or 28) and, if necessary, of hydraulic cylinders 21. The press according to the invention can, when a backing roll of the same size as the rolls of the press of curve 22 is employed, provide a press zone having a length of about 400 mm or more, wherein the pressing forces of the different sections can be adjusted depending on how many pressure pockets and interposed pressure lines the counterpart comprises. In this case, a force of 1200–1600 kN/m, for example, can be directed to the web in the press. This range is represented by the shaded area. The maximum pressure, at approximately 80 MPa, is reached at the trailing end of the nip.

What is claimed is:

1. A press for the dewatering of a fibre web, which press comprises a roll, a counterpart for the roll and an endless press belt movable on the counterpart, wherein a flexible press plate, anchored in the counterpart at one of the edges running in the longitudinal direction of the counterpart, is arranged on the surface of the counterpart located in the press zone, and hydrostatic pressure chambers, separated from each other by hydraulic pressure lines running in the longitudinal direction of the counterpart, are arranged under said press plate, and wherein an elastic film is arranged between the press plate and the counterpart, and attached at least to both the long edges of the press plate in a fluid-tight manner.

2. A press for the dewatering of a fibre web, which press comprises a roll, a counterpart for the roll and an endless press belt movable on the counterpart, wherein a flexible press plate, anchored in the counterpart at one of the edges running in the longitudinal direction of the counterpart, is arranged on the surface of the counterpart located in the press zone, and hydrostatic pressure chambers, separated from each other by hydraulic pressure lines running in the longitudinal direction of the counterpart, are arranged under said press plate, wherein a beam is mounted in the counterpart, at the unanchored edge of the press plate, in the longitudinal direction of the counterpart, and hydraulic cylinders arranged between this and the body of the counterpart, the beam arranged to press said edge of the press plate toward the roll by the force exerted by the hydraulic cylinders.

3. The press according to claim 2, wherein the operating pressure of the hydraulic cylinders is adjustable individually or by groups.

4. A press for the dewatering of a fibre web, which press comprises a roll, a counterpart for the roll and an endless press belt movable on the counterpart, wherein a flexible press plate, anchored in the counterpart at one of the edges running in the longitudinal direction of the counterpart, is arranged on the surface of the counterpart located in the press zone, and hydrostatic pressure chambers, separated from each other by hydraulic pressure lines running in the longitudinal direction of the counterpart, are arranged under said press plate, wherein the leading edge of the press plate is movably anchored in the counterpart so as to enable said edge to move toward the roll during pressing.

5. A press for the dewatering of a fibre web comprising:

a roll;

a counterpart for the roll; and an endless press belt movable on the counterpart, wherein a flexible press plate, having a leading edge running in a longitudinal direction of the counterpart, is anchored in the counterpart, and a trailing edge is movably mounted and is arranged on the surface of the counterpart located in a press zone, and in that hydrostatic pressure chambers, separated from each other by hydraulic pressure lines running in the longitudinal direction of the counterpart, are arranged under the flexible press plate.

6. The press according to claim 5, wherein an elastic film is arranged between the flexible press plate and the counterpart and attached at least to both the long edges of the flexible press plate in a fluid-tight manner.

7. The press according to claim 5, wherein a beam is mounted in the counterpart at an unanchored edge of the flexible press plate in the longitudinal direction of the counterpart, and hydraulic cylinders are arranged between the beam and the body of the counterpart, and wherein the beam is arranged to press the unanchored edge of the press plate toward the roll by a force exerted by the hydraulic cylinders.

8. The press according to claim 7, wherein the operating pressure of the hydraulic cylinders is adjustable individually or by groups.

9. The press according to claim 5, wherein the hydraulic pressure lines are flexible pressure hoses.

10. The press according to claim 5, wherein the hydraulic pressure lines are steel pipes.

11. The press according to claim 5, wherein an operating pressure of the hydrostatic pressure chambers and of the hydraulic pressure lines is individually adjustable.

12. The press according to claim 5, wherein the leading edge of the press plate is movably anchored in the counterpart so as to enable the leading edge to move toward the roll during pressing.

* * * * *